US007395801B2

(12) United States Patent
Yuasa et al.

(10) Patent No.: US 7,395,801 B2
(45) Date of Patent: Jul. 8, 2008

(54) TWO-CYCLE COMBUSTION ENGINE

(75) Inventors: Tsuneyoshi Yuasa, Kobe (JP); Isao Yoshimizu, Kobe (JP); Masanori Kobayashi, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 11/606,259

(22) Filed: Nov. 28, 2006

(65) Prior Publication Data

US 2007/0119404 A1 May 31, 2007

(30) Foreign Application Priority Data

Nov. 29, 2005 (JP) ..... 2005-343511

(51) Int. Cl.
*F02B 75/02* (2006.01)
*F02B 33/04* (2006.01)

(52) U.S. Cl. ..... 123/195 R; 123/73 PP

(58) Field of Classification Search ..... 123/195 R, 123/73 PP

See application file for complete search history.

(56) References Cited

U.S. PATENT DOCUMENTS 6,216,660 B1 * 4/2001 Ryu et al. ..... 123/196 W

FOREIGN PATENT DOCUMENTS

JP 2003-227405 8/2003

* cited by examiner

*Primary Examiner*—Noah Kamen

(57) ABSTRACT

To provide a two cycle combustion engine utilizing a connecting structure of a shape that can be formed inexpensively with a simple process to enable the efficiency of cooling of the cylinder block to be maintained at a high level and, also, that can firmly connect the cylinder block with the crankcase with fastening forces exerted by the fastening bolts, the two cycle combustion engine includes a crankcase 2 including first and second crank casings 2A and 2B that are split in a direction conforming to a crank axis C for operatively supporting a crankshaft 11, and a cylinder block 1 having a cylinder bore 1a defined therein and fixedly mounted atop the crankcase 2 by means of a plurality of fastening members 38 and 39 fitted in a direction upwardly from a crankcase-side.

15 Claims, 11 Drawing Sheets

TWO-CYCLE COMBUSTION ENGINE

BACKGROUND OF THE INVENTION

1. Field of the Invention

The present invention relates generally to a small-size two cycle combustion engine of a kind used as a drive source for a work machine or equipment such as, for example, a brush cutter. More specifically, the present invention relates to the two cycle combustion engine of a structure, in which a cylinder block is connectedly mounted on a crankcase that is divided into two crank casings in a direction axially of a crankshaft accommodated in the crankcase.

2. Description of the Prior Art

In the small-size combustion engine of a type utilizing the crankcase that is divided into two crank casings in a direction axially of the crankshaft, a connecting structure has been hitherto generally employed, in which fastening bolts inserted from above into corresponding insertion holes defined in a cylinder block flange at a lower portion of the cylinder block are threadingly engaged in associated internally threaded holes defined in the crankcase. Since in this known connecting structure, the fastening bolts are threaded successively into the respective internally threaded holes, from above in a direction axially of the cylinder, by the use of a bolt fastening tool, cooling fins integral with the cylinder block are required to be formed with a plurality of coaxially aligned series of cuts or throughholes (hereinafter referred to as series-aligned tool insertion holes), one series defined for each fastening bolt, for the passage of the bolt fastening tool therethrough. For this reason, the use of this known connecting structure has been found involving a problem associated with reduction in cooling performance of the cylinder block as the total surface area of the cooling fins is reduced in the presence of the series-aligned tool insertion holes in the cylinder block. Also, the presence of those tool insertion holes necessarily causes the cooling fins to represent rugged shapes particularly in a direction circumferentially of the cylinder block and also causes the thermal transmission to be uneven, eventually resulting in lowering of the cooling efficiency with which the cylinder block is cooled.

On the other hand, the Japanese Laid-open Patent Publication No. 2003-227405, published Aug. 15, 2003, for example, discloses another type of connecting structure, which does not require the use of the series-aligned tool insertion holes so that a relatively high efficiency of cooling the cylinder block can be maintained. According to this known connecting structure, a plurality of fastening bolts arranged circumferentially of that lower portion of the cylinder block are threaded to the crankcase in a fashion inclined relative to the cylinder axis to avoid interference with the cooling fins. With this known connecting structure, the cooling fins integral with the cylinder block do in no way interfere the passage of the bolt fastening tool and, hence, the fastening work performed with the bolt fastening tool and, therefore, the use of the series-aligned tool insertion holes is effectively eliminated. Accordingly, the total surface area of the cooling fins need not be sacrificed and, consequently, the efficiency of cooling of the cylinder block can be advantageously maintained at a high level.

However, the connecting structure disclosed in the above mentioned patent publication still has a problem. Specifically, while respective mating surfaces of the cylinder block and the crankcase lie perpendicular to the cylinder axis, bolt bearing surfaces for receiving the respective fastening bolts must be defined inclined relative to the plane of interface between the mating surfaces of the cylinder block and the crankcase. For this reason, not only is threading of the crankcase complicated and difficult to perform, but the fastening force, with which the crankcase and the cylinder block are bolted together, is lowered by a quantity corresponding to the extent of inclination of the bolt bearing surfaces.

In view of the foregoing, the present invention is intended to provide a two cycle combustion engine utilizing a connecting structure of a shape that can be formed inexpensively with a simple process while enabling the efficiency of cooling of the cylinder block to be maintained at a high level and, also, that can firmly connect the cylinder block with the crankcase with fastening forces exerted by the fastening bolts.

SUMMARY OF THE INVENTION

In order to accomplish the foregoing object of the present invention, there is provided in accordance with the present invention, a two cycle combustion engine including a crankcase for operatively supporting a crankshaft and including first and second crank casings that are split in a direction conforming to an axis of the crankshaft, and a cylinder block connected with an upper portion of the crankcase by means of a fastening member. The fastening member is fitted in a direction upwardly from a crankcase-side.

According to the present invention, since the fastening members are fitted in the direction upwardly from the crankcase-side, the presence of cooling fins integral with the cylinder block does in no way disturb the passage of the fastening tool at the time the fastening members are to be fitted. Accordingly, there is no need to form any series-aligned tool insertion holes in the cooling fins of the cylinder block for the passage of the fastening tool and, therefore, an undesirable reduction of the total surface area of the cooling fins can be advantageously avoided to allow the efficiency of cooling of the cylinder block to be maintained at a high level. Also, the fastening members can be set to extend in a direction parallel to the cylinder axis so that bolt mounting areas can be simplified in shape. Yet, by the fastening members extending parallel to the cylinder axis, the crankcase and the cylinder block can be firmly connected together with a high tightening force.

In one preferred embodiment of the present invention, the cylinder block may be formed with threaded holes and the crankcase may also be formed with a mating fastening-member insertion hole, which is aligned with the threaded holes in the cylinder block when the latter is mounted atop the crankcase. In such case, the fastening member may be a fastening bolt that is passed through the respective insertion hole to be threaded into the threaded hole to connect the cylinder block and the crankcase together. This is particularly advantageous in that the connecting structure can be simplified since the cylinder block and the crankcase can be firmly connected together by means of the fastening bolts.

In another preferred embodiment of the present invention, the first crank casing may be formed with a recess. The recess defines a bolt access passage through which the corresponding fastening bolt can be fastened to or removed from the cylinder block. Formation of those recesses allows the use of the fastening bolts of a relatively short length to advantageously accomplish a firm connection between the crankcase and the cylinder block.

In a further preferred embodiment of the present invention, the second crank casing may be formed with a fan covering portion covering a fan of the engine and having an air suction opening for the fan defined therein, in which case the air suction opening forms a bolt access passage through which the corresponding fastening bolt can be fastened to or removed from the cylinder block. This is particularly advantageous in that since the fastening bolts can be passed or removed by the fastening tool passed through the air suction openings, the fastening bolts of a relatively short length can be used.

According to the present invention, the cylinder block preferably has an air intake passage defined therein for introducing air from one side of the cylinder block to a scavenging passage of the engine. In this case, the air intake passage is positioned above the fastening members and open at the one side of the cylinder block. According to this structural feature, this air intake passage need not be so shaped as to be curved to bypass respective points of connection defined by the fastening members, but is so shaped as to linearly communicate from the opening on the one side of the cylinder block to the scavenging passage and, accordingly, the air intake passage can easily be formed in the cylinder block by the use of a die assembly. In other words, in the prior art, in order to secure the space for insertion of the fastening tool above the fastening bolts, the intake passages are formed by means of a die cutting so as to extend in a forward and rearward direction with such opening closed by a lid member. However, in place of such prior art construction, the present invention permits the intake passage to be formed by a die cutting in one direction and, therefore, not only is the use of any lid member dispensed with, but the manufacturing cost and the number of component parts can be reduced advantageously.

In the structure described above, in which the air intake passage is positioned above the fastening members and open at the one side of the cylinder block, the scavenging passage referred to above may preferably be provided in two pairs, respective scavenging passages of each pair being positioned across a cylinder bore of the cylinder block and wherein the air intake passage is fluidly connected with the pairs of the scavenging passages. According to this structural feature, in the two cycle combustion engine of an air scavenging type, in which prior to the scavenging of the combustion chamber with the air/fuel mixture, the scavenging with air is performed, the air can be simultaneously supplied from the air intake passage to the pairs of the scavenging passages during an intake stroke of the engine so that undesirable blow-off of the air/fuel mixture from an exhaust port during a scavenging stroke of the engine can be avoided effectively.

One of the pairs of the scavenging passages close to the exhaust port may be fluidly connected with the air intake passage. According to this structural feature, in the two cycle combustion engine of the air scavenging type discussed above, the air is supplied from the air intake passage to that pair of the scavenging passages adjacent the exhaust port during the intake stroke so that during the scavenging stroke the air/fuel mixture ready to enter the combustion chamber can be blocked by the air introduced from the pair of the scavenging passage and drifting in the vicinity of the exhaust port, thereby effectively avoiding the undesirable blow-off of the air/fuel mixture from the exhaust port.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
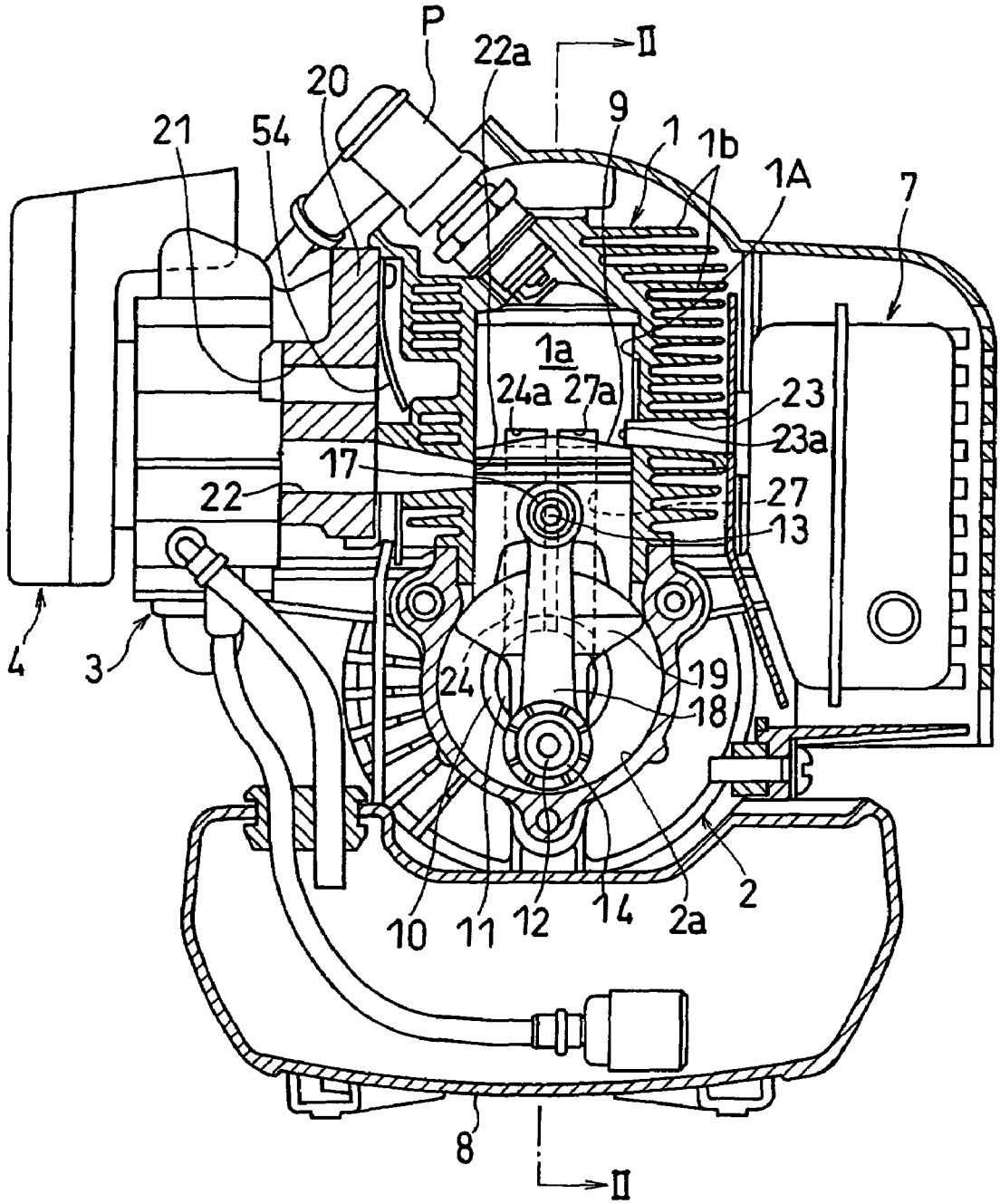
FIG. 1 is a traverse cross-sectional view of a two cycle combustion engine according to a first preferred embodiment of the present invention.
Figure 2:
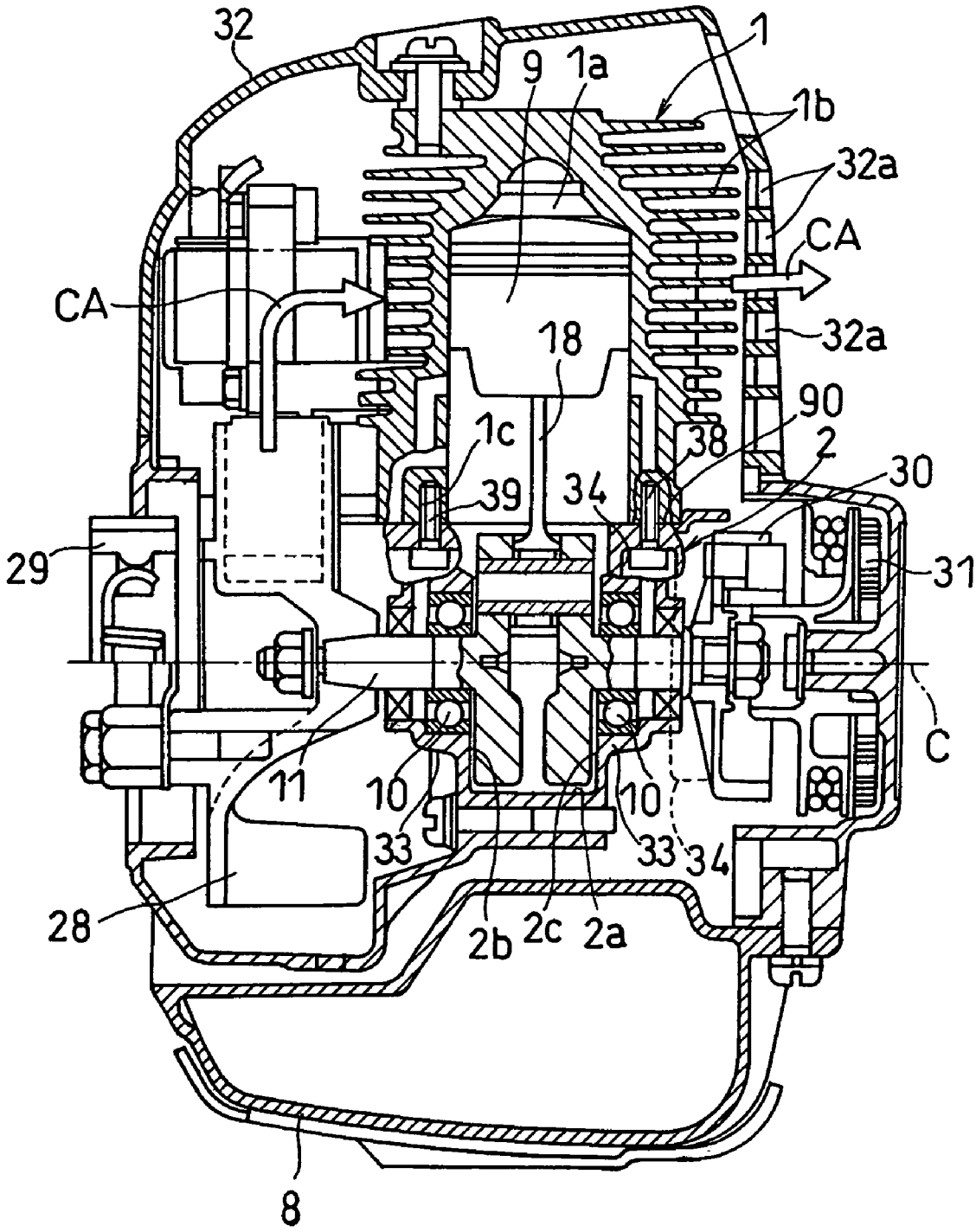
FIG. 2 is a longitudinal cross-sectional view taken along the line II-II in FIG. 1.

Hereinafter, the present invention will be described in connection with preferred embodiments thereof with reference to the accompanying drawings. In particular, FIG. 1 illustrates a traverse cross-sectional view of the two cycle combustion engine according to a first preferred embodiment of the present invention as viewed in a direction transverse to the axis about which a crankshaft rotates, and FIG. 2 shows a longitudinal cross-section taken along the line II-II shown in FIG. 1. In this embodiment, a small-size two-cycle internal combustion engine utilizable in a brush cutter is illustrated.

Referring now to FIG. 1, the two cycle combustion engine shown therein includes a cylinder block 1 having a combustion chamber 1*a* defined therein, and a crankcase 2 having a crank chamber 2*a* defined therein, in which the cylinder block 1 is connected with an upper portion of the crankcase 2. Each of the cylinder block 1 and the crankcase 2 is made of a metallic material such as, for example, aluminum by means of any known metal molding technique using a die assembly. A carburetor 3 and an air cleaner unit 4, both forming a part of a fuel intake system, is secured to a first side wall portion, for example, a left side wall portion as viewed in FIG. 1, of the cylinder block 1 through an thermal insulator block 20 fixedly interposed between the cylinder block 1 and the carburetor 3 for insulating a heat transmission from the cylinder block 1 to the carburetor 3. On the other hand, a muffler 7 forming a part of an engine exhaust system is secured to a second, i.e., right side wall portion of the cylinder block 1 opposite to the first side wall portion thereof. A fuel tank 8 is secured from below to a bottom portion of the crankcase 2 on one side opposite to the cylinder block 1.

The cylinder block 1 has a multiplicity of spaced cooling fins 1*b* formed integrally therewith so as to protrude outwardly while extending around the cylinder block 1, and is formed with a cylinder bore 1A defined therein. The cylinder bore 1A accommodates a reciprocating piston 9 therein to move up and down in a direction axially of the cylinder bore 1A.

As best shown in FIG. 2, the crankcase 2 has front and rear end walls 2*b* and 2*c* each formed with a respective bearing housing identified generally by 33 and accommodating therein a corresponding crankshaft bearing 10. A crankshaft 11 having front and rear ends opposite to each other operatively extends within the crankcase 2 with the front and rear ends supported rotatably by the crankshaft bearings 10. As best shown in FIG. 1, a hollow crank pin 12 of the crankshaft 11 and a hollow piston pin 13 carried by the piston 9 are drivingly connected together through a connecting rod 18. Specifically, the connecting rod 18 has a big end, carrying a big end bearing 14, and a small end carrying a small end bearing 17 opposite to the big end bearing 17, and the big end bearing 14 is rotatably connected with the crank pin 12 while the small end bearing 17 is rotatably connected with the piston pin 13. The crankshaft 11 is provided with crank webs 19 on respective sides of the crank pin 12. An ignition plug P is mounted atop the cylinder block 1.

It is to be noted that a plane of interface 90 between the respective mating surfaces of the cylinder block 1 and the crankcase 2 lies parallel to an axis C of the crankshaft 11 about which the crankshaft 11 rotates.

The thermal insulator block 20 has an air supply passage 21 and an air/fuel mixture supply passage 22 defined therein so as to extend parallel to each other and communicated with the cylinder block 1 through the first side wall portion of the cylinder block 1, with the air supply passage 21 positioned above the air/fuel mixture supply passage 22. On the other hand, the second side wall portion of the cylinder block 1 referred to previously has an exhaust passage 23 defined therein and having an exhaust port 23*a* opening at the inner peripheral surface defining the cylinder bore 1A so as to communicate with the combustion chamber 1*a*, so that exhaust gases (burned gases) can be exhausted to the outside through this exhaust passage 23 by way of the muffler 7.

First and second scavenging passages 24 and 27, each communicating between the combustion chamber 1*a* in the cylinder block 1 and the crank chamber 2*a* in the crankcase 2 through the crankshaft bearing 10, are defined in part in the cylinder block 1 and in part in the wall of the crankcase 2 so as to extend in a direction substantially or generally parallel to the longitudinal axis of the cylinder bore 1A. The first and second scavenging passages 24 and 27 have respective upper ends defining first and second scavenging ports 24*a* and 27*a*, which are defined in an inner peripheral surface of the cylinder block 1 at a level lower than an uppermost portion of the exhaust port 23*a*.

It is, however, to be noted that the second scavenging passage 27 is positioned at a location closer to the exhaust port 23*a* than the first scavenging passage 24. It is also to be noted that as will be detailed later, each of the first and second scavenging passages 24 and 27 is, in the illustrated embodiment, employed in one pair. Specifically, respective scavenging passages 24, 24, and 27, 27 of each pair are positioned in symmetrical relation to each other with respect to a vertical plane containing a longitudinal axis of the exhaust passage 23.

Referring to FIG. 2, one of the opposite front and rear ends, for example, the front end (a left end in FIG. 2), of the crankshaft 11, which is rotatably supported within the crankcase 2 by means of the crank bearings 10, has a cooling fan 28 mounted thereon for rotation together therewith, which fan 28 concurrently serves as a flywheel. A centrifugal clutch 29 for transmitting an output of the combustion engine to a drive transmission shaft (not shown) of the brush cutter is fitted to the cooling fan 28. On the other hand, the rear end (a right end in FIG. 2) of the crankshaft 11 has a starter pulley 30 mounted thereon for rotating together therewith, and a recoil starter 31 for driving the crankshaft 11 through the starter pulley 30 is arranged at a location axially outwardly of the starter pulley 30.

A stream of cooling air CA induced by the cooling fan 28 during the rotation of the latter is guided by a shroud 32, covering the cylinder block 1 and the muffler 7, so as to flow interspaces each defined between the neighboring cooling fins 1*b* and 1*b* to cool the cylinder block 1. The stream of cooling air CA used to cool the cylinder block 1 in this manner is subsequently discharged to the outside through one or a plurality of vent holes 32*a* defined in the shroud 32.

Figure 3:
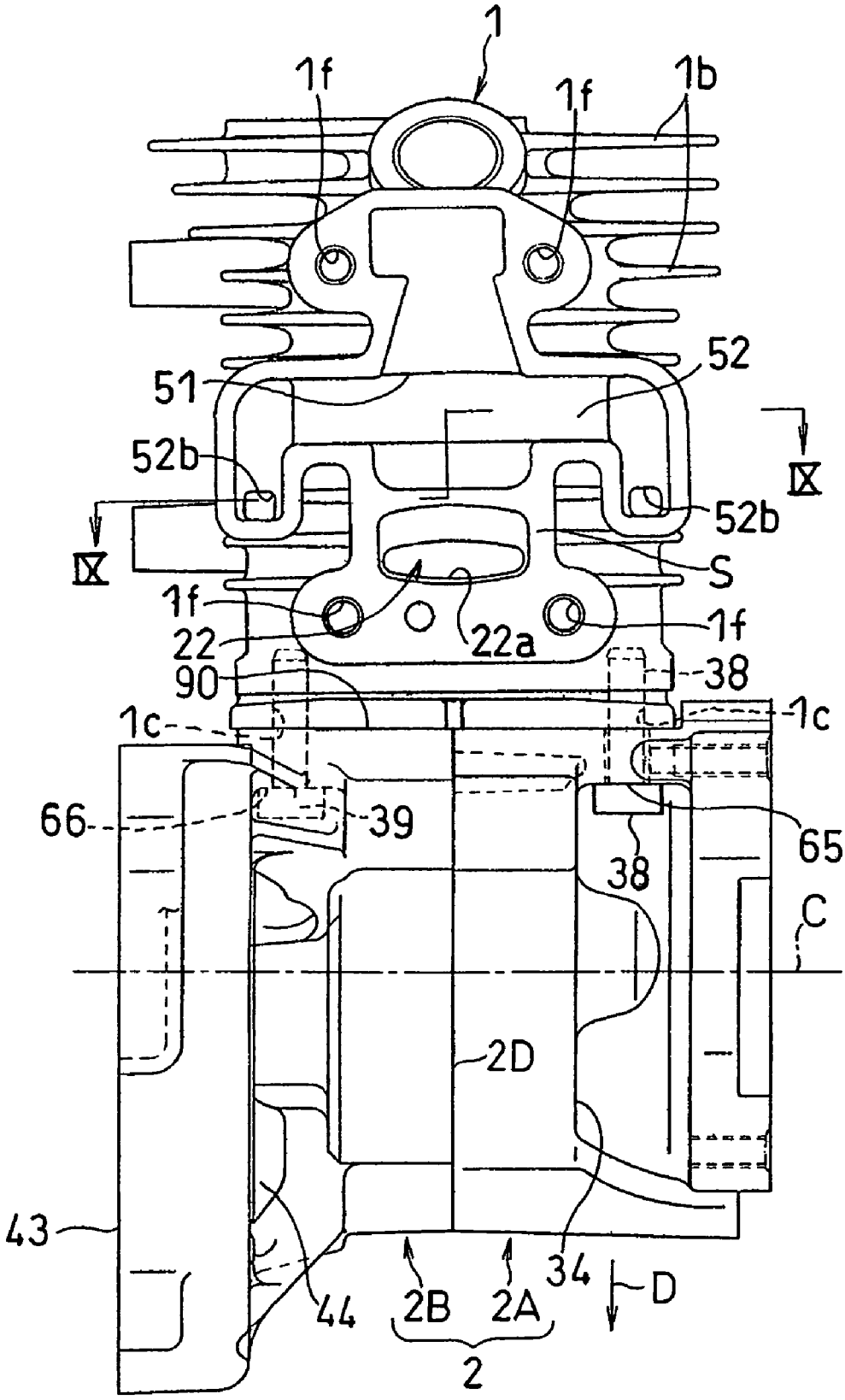
FIG. 3 is a side view of the two cycle combustion engine according to the first preferred embodiment, including a cylinder block and a crankcase, as viewed in a direction similar to the direction of view of FIG. 2.

FIG. 3 illustrates, in a side view of the two cycle combustion engine including the cylinder block 1 and the crankcase 2, as viewed in the same direction as that viewed in FIG. 2. As shown therein, the crankcase 2 is of a two-piece construction including first and second crank casings 2A and 2B split in a direction substantially parallel to the crank axis C. Those first and second crank casings 2A and 2B have respecting mating faces lying substantially perpendicular to the axis C of the crankshaft 11 and connected together at a plane of connection 2D by means of three connecting bolts as will be described later.

Figure 4:
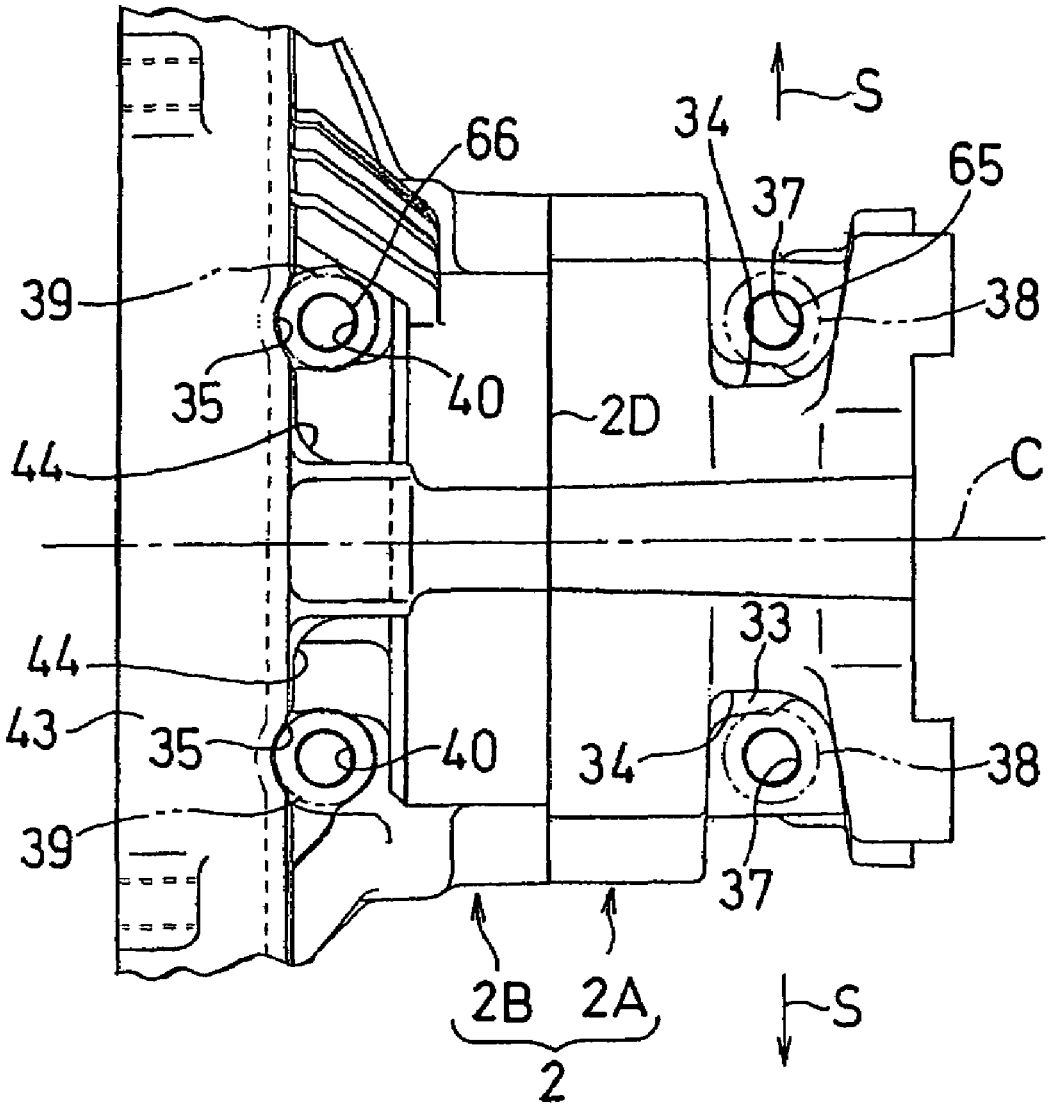
FIG. 4 is a bottom plan view of the two cycle combustion engine according to the first preferred embodiment.

Referring now to FIG. 4 showing a bottom plan view of the combustion engine shown in FIG. 3, the first crank casing 2A is formed with a pair of recesses 34 defined therein on opposite sides of the axis C of the crankshaft 11 so as to open in a lateral direction S and also in a downward direction D (See FIG. 3.) Those recesses 34 are arranged at an outer side position of a bearing housing 33 formed in the first crank casing 2A to support the crankshaft 11. Respective portions of the first crank casing 2A, which open to the outside through the recesses 34, are formed with fastening-member insertion holes 37 defined therein so as to open upwardly. Each of those recesses 34 defined in the first crank casing 2A as described above forms a bolt access passage through which a corresponding fastening member in the form of a fastening bolt 38 can be fastened to or removed from the cylinder block 1.

On the other hand, the second crank casing 2B is formed with a pair of fastening-member insertion holes 40 defined therein so as to open upwardly, but not with recesses similar to the recesses 34 in the first crank casing 2A. The second crank casing 2B is formed with a fan covering 43 for covering exteriorly of the cooling fan 28. This fan covering 43 has a plurality of cooling air suction openings 44 defined therein, and two of those openings 44 are provided immediately below the fastening-member insertion holes 40. Accordingly, each of those two suction openings 44 forms a bolt access passage, through which a corresponding fastening bolt 39 to be passed from below can be fastened to or removed from the cylinder block 1. In order to avoid interference of heads of the fastening bolts 39 with the fan covering 43, which may occur when the fastening bolts 39 are inserted from the outside of the fan covering 43 through the associated suction openings 44, small recesses 35 are formed in the fan covering 34.

Figure 5A:
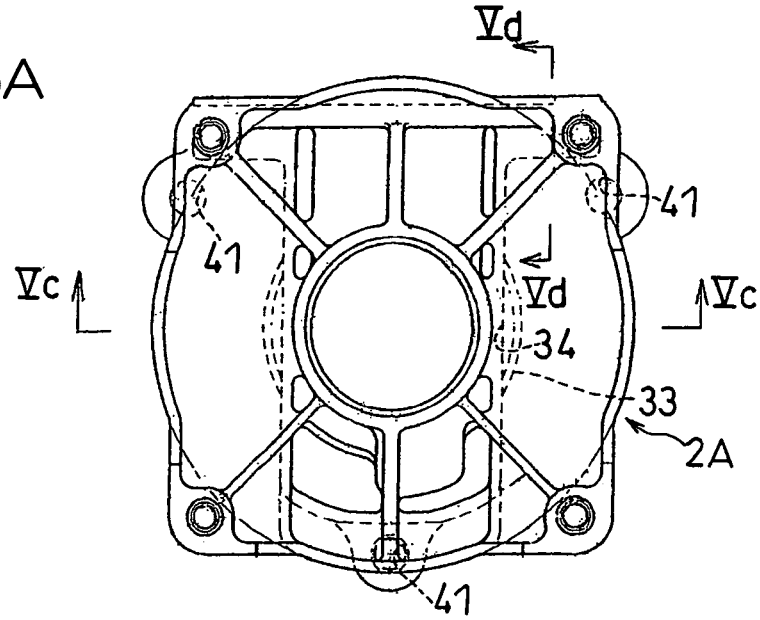
FIG. 5A shows a backside-view of a first crank casing, one of split crank casings forming respective parts of the crankcase, as viewed in a direction counter to a plane of connection between the crank casings.
Figure 5B:
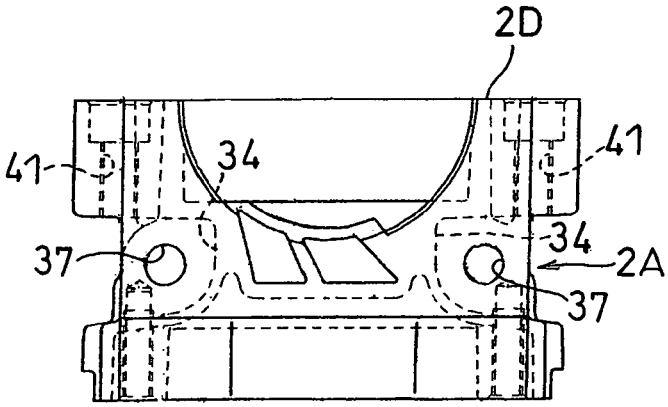
FIG. 5B shows a plan view of the first crank casing.
Figure 5C:
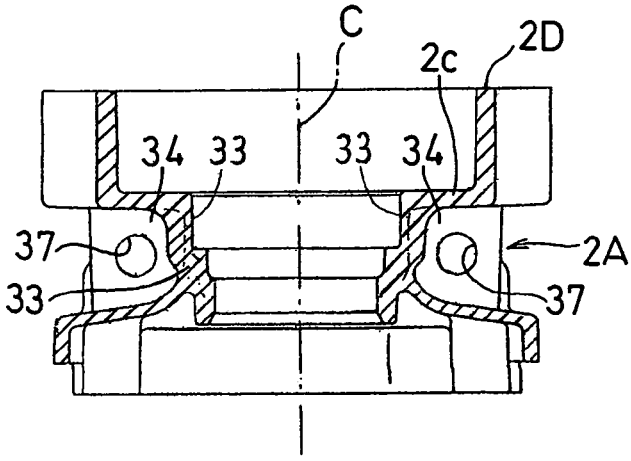
FIG. 5C shows a cross-sectional view taken along the line Vc-Vc in FIG. 5A.
Figure 5D:
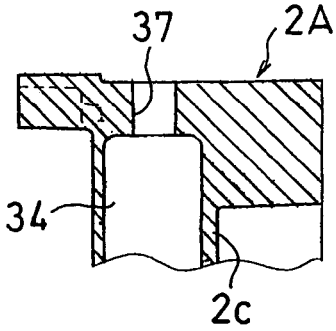
FIG. 5D shows a cross-sectional view taken along the line Vd-Vd in FIG. 5A.

FIGS. 5A-5D illustrate the details of the first crank casing 2A, in which FIG. 5A is a backside representation as viewed in a direction counter to the plane of connection 2D, FIG. 5B is a plan view of the first crank casing 2A, FIG. 5C is a cross-sectional view taken along the line Vc-Vc in FIG. 5A, and FIG. 5D is a cross-sectional view taken along the line Vd-Vd in FIG. 5A. As best shown in FIG. 5C, each of the recesses 34 in the first crank casing 2A is so formed as to cut as large as possible into the wall of the first crank casing 2A in a direction towards the axis C of the crankshaft 11 to such an extent that depletion of a portion of the wall of the bearing housing 33 corresponding to the site of the respective recess 34 will not result in any inconvenience in functional aspect of the bearing housing 33 including reduction of the physical strength. Also, as best shown in FIG. 5D, each of the recesses 34 so formed has a sufficiently larger width than the corresponding fastening-member insertion hole 37 so as to facilitate insertion of a bolt fastening tool from below in readiness for threading the corresponding fastening bolt 38. As best shown in FIG. 5A, the first crank casing 2A is also formed with three, substantially circumferentially equally spaced bolt holes 41 for receiving respective connecting bolts 49 used to connect the first and second crank casings 2A and 2B (referred to FIG. 4) together as will be described later.

Figure 6A:
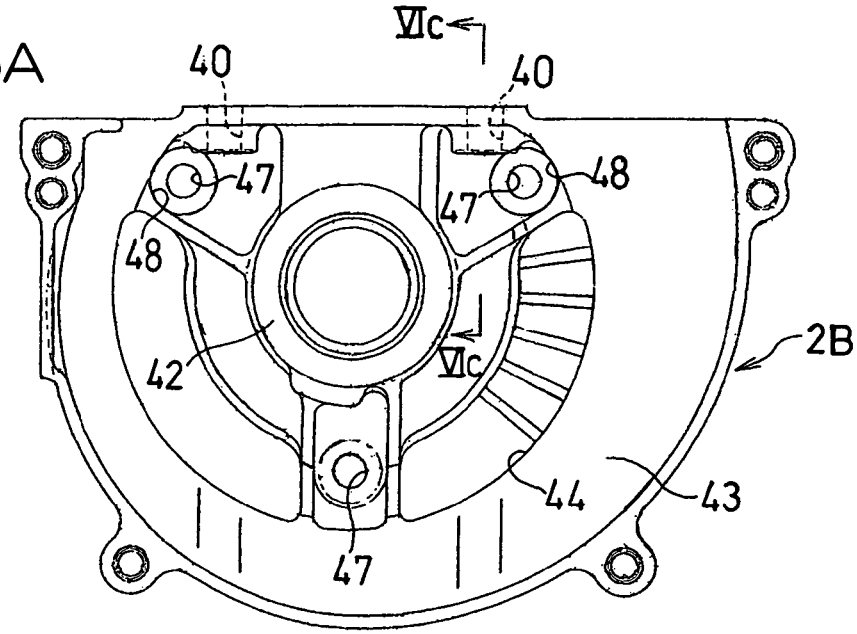
FIG. 6A shows a front view of a second crank casing, the other of the split crank casings forming respective parts of the crankcase, as viewed in a direction counter to the plane of connection between the crank casings.
Figure 6B:
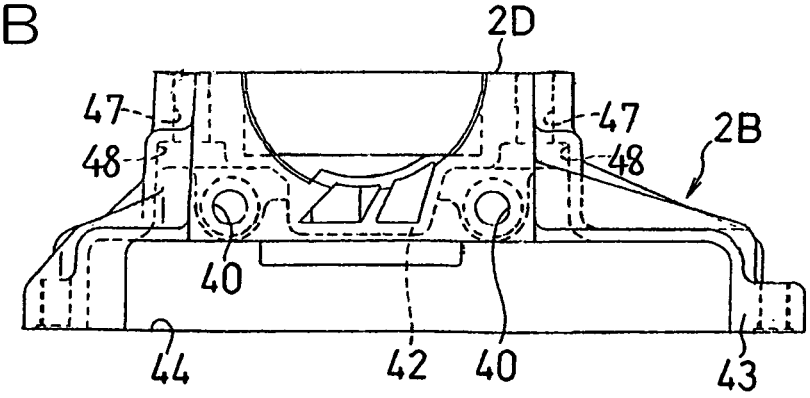
FIG. 6B shows a plan view of the second crank casing.
Figure 6C:
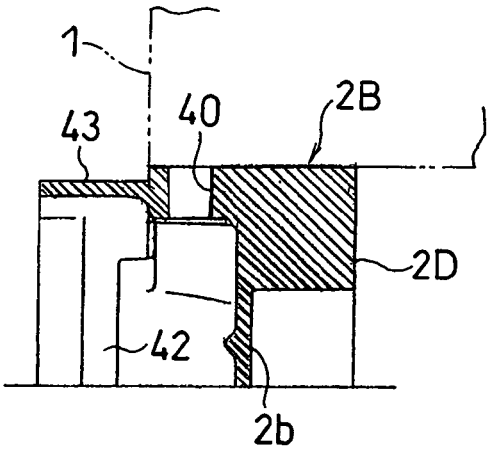
FIG. 6C shows a cross-sectional view taken along the line VIc-VIc in FIG. 6A.

FIGS. 6A-6C illustrate the details of the second crank casing 2B, in which FIG. 6A is a front side representation of the second crank casing 2B as viewed in a direction counter to the plane of connection 2D, FIG. 6B is a plan view of the second crank casing 2B, FIG. 6C is a cross-sectional view taken along the line VIc-VIc in FIG. 6A. The second crank casing 2B has three bolt holes 47 defined therein at respective locations alignable with the three bolt holes 41 (shown in FIG. 5A) in the first crank casing 2A. Those three bolt holes 47 are, as best shown in FIG. 6B, formed in respective bottoms of round recesses 48 formed in a surface opposite to the mating surface of the second crank casing 2B that defines the plane of connection 2D in cooperation with the mating surface of the first crank casing 2B. On the other hand, the fastening-member insertion holes 40 are, as best shown in FIG. 6C, positioned outwardly of a front end wall 2*b* of the crankcase 2 and at a root portion of the fan covering 43.

Figure 7:
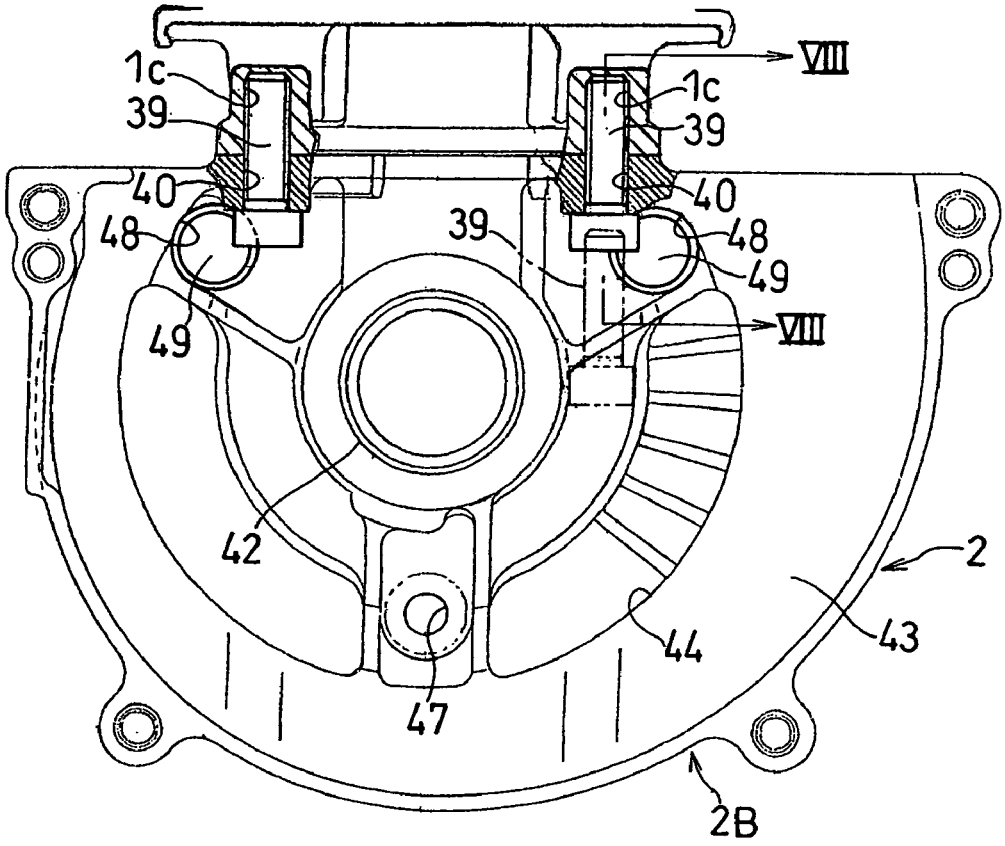
FIG. 7 is a fragmentary front elevational view, with portions shown in section, of the two cycle combustion engine, showing the manner of connection of the first and second crank casings with each other.
Figure 8:
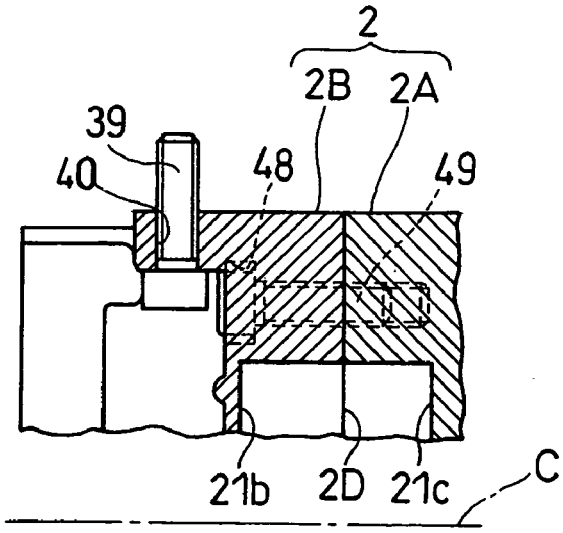
FIG. 8 is a cross-sectional view taken along the-line VIII-VIII in FIG. 7.

FIG. 7 is a fragmentary front elevational view showing, in a sectional representation, points of connection between the crankcase 2 and the cylinder block 1 as viewed from the second crank casing 2B. As shown therein, when the fastening bolts 39, first passed through the suction opening 44 in the fan covering 43 and then through the fastening-member insertion holes 40, are firmly threaded into respective bolt holes 1*c* defined in the cylinder block 1, the cylinder block 1 and the crankcase 2 can be firmly connected together. Of the three connecting bolts 49 in the second crank casing 2B used to connect the latter with the first crank casing 2A, the uppermost two connecting bolts 49 are respectively positioned in close proximity to the fastening bolts 39 used to connect the crankcase 2 to the cylinder block 1. Each of the three bolt holes 47 for the respective connecting bolts 49 are so formed in the bottom of the respective round recess 48 that, as best shown in FIG. 8, the connecting bolt 49 can be inwardly set back in a direction along the axis C of the crankshaft 11, and, accordingly, the connecting bolt 49 does not interfere with the associated fastening bolt 39. It is to be noted that prior to the crankcase 2 being secured to the cylinder block 1 by means of the fastening bolts 39, the crankcase 2 is assembled by means of the connecting bolts 49 with the respective mating surfaces of the first and second crank casings 2A and 2B held in firm contact with each other at the plane of connection 2D.

It will thus be understood that as FIG. 8 makes it clear, the respective heads of the connecting bolts 49 for assembling the crankcase 2 are substantially embedded within the recesses 48 and, therefore, insertion of the fastening bolts 39 towards the respective fastening-member insertion holes 40 through the air suction openings 44 (FIG. 4) in the fan covering 43 will in no way be disturbed by the otherwise presence of the bolt heads.

The details of the cylinder block 1 will now be described. An area of the first side wall portion of the cylinder block 1 adjacent the carburetor 3 is formed with an opening 51 as best shown in FIG. 3, with a downstream passage portion of the air/fuel mixture supply passage 22 positioned below the opening 51. This downstream passage portion of the air/fuel mixture supply passage 22 has an exit defining an air/fuel mixture supply port 22*a* open at the inner peripheral surface of the cylinder block 1 defining the cylinder bore 1A. The cylinder block 1 has a connecting seat S in the form of a flat connecting face defined in an outer side area thereof, and the thermal insulator block 20 (FIG. 1) is secured to the connecting seat S by means of a plurality of screw members (not shown), which are inserted through corresponding mounting holes (not shown) defined in the thermal insulator block 20 and then threadingly engaged in corresponding threaded holes 1*f* on the first side wall portion of the cylinder block 1.

Figure 9A:
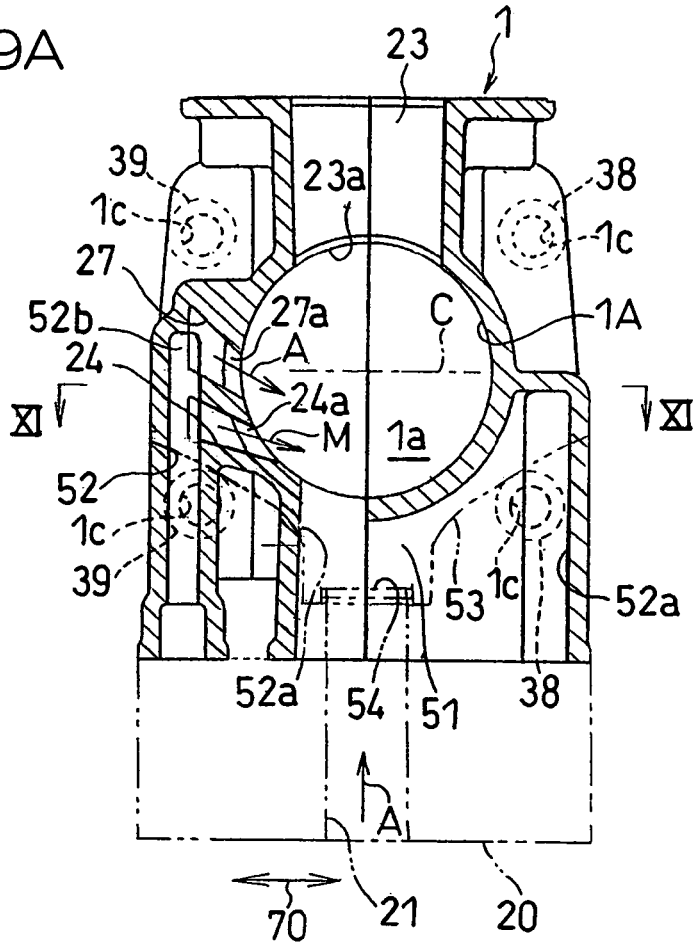
FIG. 9A is a cross-sectional view taken along the line IV-IV in FIG. 3.

Referring to FIG. 9A showing a cross-section taken along the IX-IX in FIG. 3, the cylinder block 1 is formed with the two pairs of the scavenging passages 24, 24 and 27, 27 defined therein. Respective scavenging passages of each pair are positioned across the cylinder bore 1A, although only ones of respective pairs, or the first and second scavenging passages 24 and 27 on one side of the cylinder bore 1A are shown therein. The first and second scavenging passages 24 and 27 of those pairs are communicated with an air intake passage 52, which is defined in the cylinder block 1 so as to extend in a direction substantially perpendicular to the axis C of the crankshaft 11 for introducing an air A thereto from the air supply passage 21 defined in the thermal insulator block 20. The thermal insulator block 20 referred to above is formed integrally with a projection 53 protruding into the opening 51 of the cylinder block 1, as will be described subsequently, to form a part of a wall surface of the air supply passage 21.

On the other hand, the opening 51 best shown in FIG. 3 and defined in that area of the first side wall portion of the cylinder block 1 adjacent the carburetor 3 is formed simultaneously with formation of the cylinder block 1 by opening a die in a direction parallel to the air supply passage 21. The projection 53 referred to and best shown in FIG. 9A above protrudes into this opening 51 to define an upstream passage portion 52*a* of the air intake passage 52.

Figure 9B:
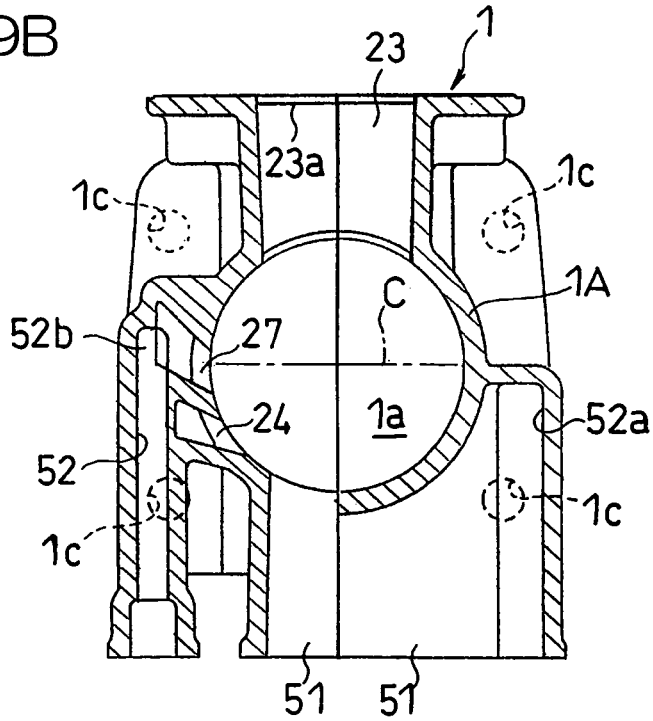
FIG. 9B is a cross-sectional view similar to FIG. 9A, showing a modification thereof.

As shown in FIG. 3, the air intake passage 52 also has a pair of downstream passage portions 52*b* defined at respective locations deep below the opposite sides of the opening 51 so as to extend generally circumferentially at a location radially outwardly from the cylinder bore 1A, terminating in communication with the first and second scavenging passage 24 and 27. Thus, the air intake passage 51 in its entirety is made up of the opening 51 in the cylinder block 1 and the projection 53 in the thermal insulator block 20. A downstream exit port of the air supply passage 21 defined in the thermal insulator block 20 is provided with a reed valve 54 which opens when the pressure inside the air intake passage 52 communicated therewith decreases down to a value lower than a predetermined pressure. It is to be noted that as best shown in FIG. 9B, the air intake passage 52 may be communicated with only the second scavenging passage 27 adjacent (closer to) the exhaust passage 23.

Figure 11:
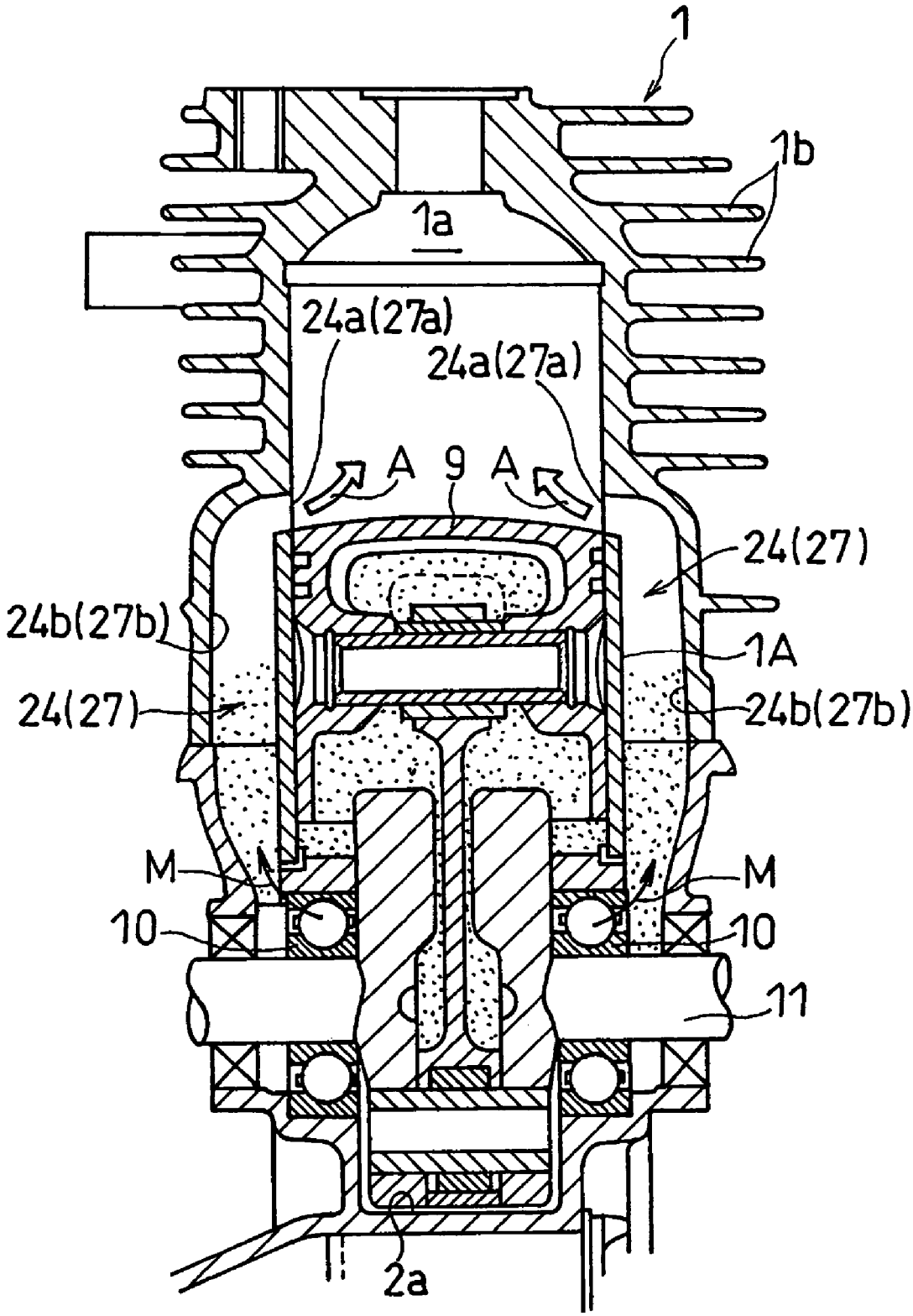
FIG. 11 is a cross-sectional view taken along the line XI-XI in FIG. 9A.

As shown in FIG. 11 showing a cross-sectional view taken along the line XI-XI in FIG. 9A, each first scavenging passage 24 includes the first scavenging port 24*a*, opening in the inner peripheral surface of the cylinder bore 1A, and a communicating passage 24*b* extending vertically downwardly from the first scavenging port 24*a* past a bottom of the cylinder block 1 to a portion of an outer side surface of the associated crankshaft bearing 10 that lies at a level intermediate of the height of the crankcase 2. The communicating passage 24*b* has a lower end communicated with the crank chamber 2*a* through a gap between inner and outer races of the crankshaft bearing 10 and then through a gap between the crank web 19 and the crankshaft bearing 10. Thus, the air A introduced from the air supply passage 21, shown in FIG. 9B, into the first scavenging passages 24 can be supplied into the combustion chamber 1*a* through the communicating passage 24*b* by way of the first scavenging port 24*a* during the scavenging stroke during which the reciprocating piston 9 undergoes a descending motion.

It is to be noted that the second scavenging passages 27 are constructed in a manner similar to the description made above in connection with the first scavenging passages 24.

Figure 10:
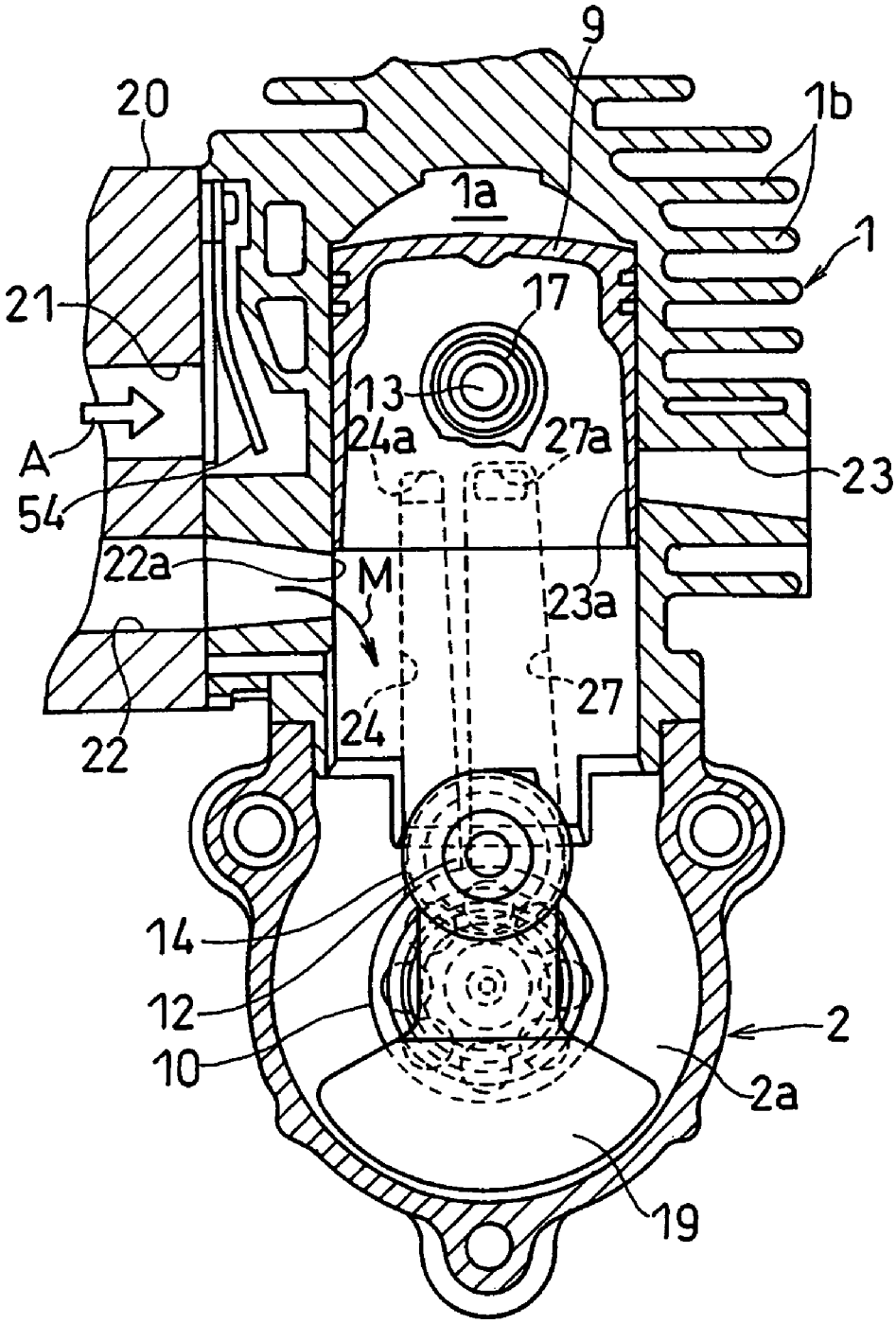
FIG. 10 is a front sectional view of the two cycle combustion engine showing the cylinder block and the crankcase shown on an enlarged scale.

Hereinafter, the operation of the two cycle combustion engine of the structure hereinabove described will be described. During the intake stroke of the two cycle combustion engine as shown in FIG. 10, an air/fuel mixture M can be directly introduced into the crank chamber 2*a* through air/fuel mixture supply port 22*a*, open at the inner peripheral surface of the cylinder block 1, when a negative pressure is developed within the crank chamber 2*a* as the reciprocating piston 9 within the cylinder bore 1A approaches a top dead center position. The air/fuel mixture M so introduces is partly used to lubricate the big end bearing 14 and the small end bearing 17 for the connecting rod 18. Since at this time a negative pressure is also developed inside the first and second scavenging passages 24 and 27, which are communicated with the crank chamber 2*a* through the crankshaft bearings 10, the air intake passage 52, which are communicated with the first and second scavenging passages 24 and 27, is also held under a negative pressure and the read valve 54 fitted to the exit port of the air supply passage 21 in the thermal insulator block 20 is consequently opened to allow the air A to be introduced from the air supply passage 21 temporarily into the first and second scavenging passages 24 and 27 through the air intake passage 52. In this way, as long as, during the intake stroke, the read valve 54 is opened by the effect of the negative pressure inside the crank chamber 2*a*, the air A is introduced at all times in the first and second scavenging passages 24 and 27 and, therefore, a sufficient amount of air required to prevent a blow-off can be secured in respective upper regions of the first and second scavenging passages 24 and 27.

During the subsequent scavenging stroke, the air/fuel mixture M and the air A are introduced into the combustion chamber through the associated first and second scavenging ports 24*a* and 27*a* of the first and second scavenging passages 24 and 27, respectively. At this time, the air A is first introduced from the first and second scavenging ports 24*a* and 27*a* as shown in FIG. 11, followed by introduction of the air/fuel mixture M and, therefore, by the action of the first introduced air A, the blow-off of the air/fuel mixture M from the exhaust port 23 can be avoided. At the time the air/fuel mixture M is introduced into the combustion chamber 1*a* through the first and second scavenging passages 24 and 27 shown in FIG. 11, the air/fuel mixture M within the crank chamber 2*a* flows into the first and second scavenging passages 24 and 27 through the gaps between the inner and outer races of the crankshaft bearings 10 and, therefore, the crankshaft bearings 10 can be lubricated with fuel and oil contained in the air/fuel mixture M.

It is to be noted that where as shown in FIG. 9B, the air A is introduced only into the second scavenging passages 27, the second scavenging ports 27*a* has to be positioned at a heightwise level somewhat higher than those of the first scavenging ports 24*a* so that during the scavenging stroke shown in FIG. 11, the reciprocating piston 9 can open the second scavenging ports 27*a* earlier than the first scavenging ports 24*a* to allow the air A to be introduced into the combustion chamber 1*a*. By so doing, the undesirable blow-off of the air/fuel mixture M from the subsequently opened first scavenging passages 24 through the exhaust port 23*a* can be avoided advantageously.

In the two cycle combustion engine so constructed as hereinbefore described, since the fastening bolts 38 and 39 are fitted from below to the crankcase 2 as shown in FIG. 3, the cooling fins 1*b* of the cylinder block 1 does in no way interfere with the threading of the fastening bolts 38 and 39 and, therefore, there is no need to form in the cooling fins 1*b* of the cylinder block 1, such series-aligned tool insertion holes hitherto required in the prior art combustion engines of a similar kind for passage of the fastening tool. Accordingly, reduction of the total surface area of the cooling fins 1*b*, hitherto encountered with the prior art combustion engines of a similar kind, can be effectively avoided to enable the efficiency of cooling of the cylinder block 1 to be maintained at a high level.

Also, since the fastening bolts 38 and 39 are set to extend in a direction perpendicular to the axis C of the crankshaft 11 and, therefore, respective mounting seats 65 and 66 (FIG. 4) for the fastening bolts 38 and 39 can be formed as a flat surface parallel to the plane of interface 90 defined between the respective mating surfaces of the cylinder block 1 and the crankcase 2, machining of the mounting seats 65 and 66 can be facilitated without incurring increase of the cost. In addition, since the fastening bolts 38 and 39 are disposed in a fashion parallel to the cylinder axis perpendicular to the crank axis C, the crankcase 2 and the cylinder block 1 can be firmly connected together with a high tightening force exerted by those fastening bolts 38 and 39.

The air intake passage 52 is positioned above the fastening bolts 38 and 39 and, when viewed from above as shown in FIG. 9A, this air intake passage 52 is not so shaped as to be curved to bypass respective points of connection defined by the fastening bolts 38 and 39, but is so shaped as to linearly communicate from the opening on one side of the cylinder block 1 to the first and second scavenging passages 24 and 27. In other words, in the prior art, in order to secure the space for insertion of the fastening tool above the fastening bolts 38 and 39, the scavenging passages are formed by means of a die cutting so as to extend in a forward and rearward direction shown by the arrow 70 with such opening closed by a lid member. See, for example, the Japanese Laid-open Patent Publication No. 2004-360656, published Dec. 24, 2004. However, in place of such prior art construction, the present invention permits the first and second scavenging passages 24 and 27 to be formed by a die cutting in one direction (in a direction downwardly of the sheet of FIG. 9A) and, therefore, not only is the use of any lid member dispensed with, but the manufacturing cost and the number of component parts can be reduced advantageously.

Figure 12:
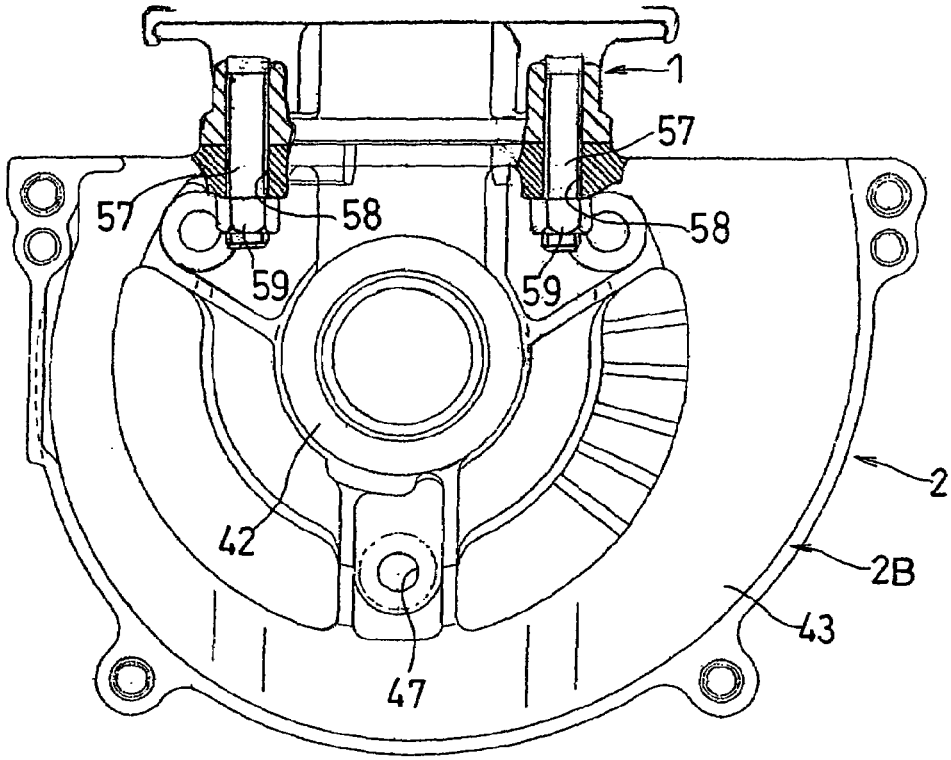
FIG. 12 is a fragmentary front view showing an important portion of the two cycle combustion engine according to a second preferred embodiment of the present invention.

It is to be noted that in place of the structure, in which the cylinder block 1 and the crankcase 2 are connected together by the use of the fastening bolts 38 and 39 such as shown and described in connection with the foregoing embodiment, such a connecting structure as shown in FIG. 12 in connection with a second preferred embodiment of the present invention can be equally employed. Specifically, in the second embodiment shown in FIG. 12, stud bolts 57 are secured to the cylinder block 1 so as to extend downwards on one hand and, on the other hand, the crankcase 2 is formed with corresponding fastening-member insertion holes 58 for receiving therein the stud bolts 57. In this case, after the cylinder block 1 is mounted on the crankcase 2 with the stud bolts 57 inserted through the fastening-member insertion holes 58, respective nuts 59 are fastened to portions of the stud bolts 57 emerging outwardly from the fastening-member insertion holes 58, thereby completing a firm connection between the cylinder block 1 and the crankcase 2 together.

Figure 13:
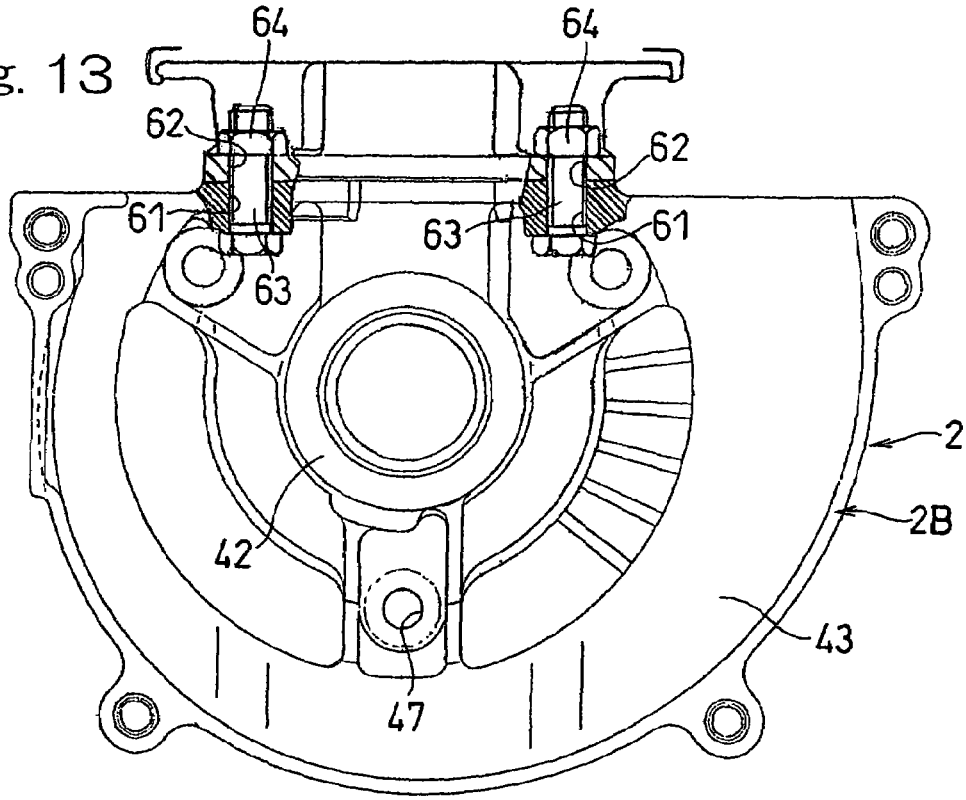
FIG. 13 is a fragmentary front view showing an important portion of the two cycle combustion engine according to a third preferred embodiment of the present invention.

Also, in a third preferred embodiment shown in FIG. 13, the crankcase 2 may be formed with fastening-member insertion holes 61 and on the other hand, the cylinder block 1 may be formed with mounting holes 62 so that after connecting bolts 63 are passed through the fastening-member insertion holes 61 and then through the mounting holes 62 aligned with the fastening-member insertion holes 61, respective nuts 64 can be fastened to portions of the connecting bolts 63 emerging outwardly from the mounting holes 62, thereby completing a firm connection between the cylinder block 1 and the crankcase 2 together.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A two cycle combustion engine which comprises:

a crankcase split along a plane orthogonal to the crankshaft axis, the crankcase having a flange uppermost thereof and adjacent a cylinder block, the flange having openings in which fasteners are upwardly inserted into a corresponding holes in the cylinder block for securing the crankcase to the block, the fasteners pressing against an underside of the flange.

2. The two cycle combustion engine as claimed in claim 1, wherein each of the holes formed in the cylinder block is a threaded hole and each of the openings formed in the crankcase is a mating insertion hole, which is aligned with the threaded hole in the cylinder block when the latter is mounted atop the crankcase and wherein each of the fasteners is a fastening bolt that is passed through the respective insertion hole to be threaded into the threaded hole to connect the cylinder block and the crankcase together.

3. The two cycle combustion engine as claimed in claim 2, wherein one of crankcase halves which cooperate to form the split crankcase is formed with a recess, defining a bolt access passage through which the corresponding fastening bolt can be fastened to or removed from the cylinder block.

4. The two cycle combustion engine as claimed in claim 3, wherein the other crank case half is formed with a fan covering portion covering a fan of the engine and having an air suction opening for the fan defined therein and wherein the suction opening forms a bolt access passage through which the corresponding fastening bolt can be fastened to or removed from the cylinder block.

5. The two cycle combustion engine as claimed in claim 1, wherein the cylinder block has an air intake passage defined therein for introducing air from one side of the cylinder block to a scavenging passage formed in the cylinder block, the air intake passage being positioned above the fasteners and open at the one side of the cylinder block.

6. The two cycle combustion engine as claimed in claim 5, wherein the scavenging passage is provided in two pairs, respective scavenging passages of each pair being positioned across a cylinder bore of the cylinder block, and wherein the air intake passage is fluidly connected with the pairs of the scavenging passages.

7. The two cycle combustion engine as claimed in claim 5, wherein the scavenging passage is provided in two pairs, respective scavenging passages of each pair being positioned across a cylinder bore of the cylinder block, and wherein the air intake passage is fluidly connected with one of the pairs of the scavenging passages, which is close to an exhaust port.

8. A combustion engine which comprises:

a crankcase for operatively supporting a crankshaft and including first and second crank casings that are split in a direction conforming to an axis of the crankshaft; and a cylinder block connected with an upper portion of the crankcase by means of a fastening bolt fitted in a direction upwardly from a crankcase-side, the cylinder block being formed with a threaded hole, the crankcase being formed with a mating insertion hole, which is aligned with the threaded hole in the cylinder block when the latter is mounted atop the crankcase and the fastening bolt, extending through the mating insertion hole and being threaded into the threaded hole to connect the cylinder block and the crankcase together, wherein the first crank casing is formed with a recess, defining a bolt access passage through which the fastening bolt is fastened to or removed from the cylinder block.

9. The combustion engine as claimed in claim 8, wherein the second crank casing is formed with a fan covering portion for covering a fan of the engine and having an air suction opening for the fan defined therein and wherein the air suction opening forms a bolt access passage through which the fastening bolt can be fastened to or removed from the cylinder block.

10. The combustion engine as claimed in claim 8, wherein the cylinder block has an air intake passage defined therein for introducing air from one side of the cylinder block to a scavenging passage formed in the cylinder block, the air intake passage being positioned above the fastening member and open at the one side of the cylinder block.

11. The combustion engine as claimed in claim 10, wherein the scavenging passage is provided in two pairs, respective scavenging passages of each pair being positioned across a cylinder bore of the cylinder block, and wherein the air intake passage is fluidly connected with the pairs of the scavenging passages.

12. The combustion engine as claimed in claim 10, wherein the scavenging passage is provided in two pairs, respective scavenging passages of each pair being positioned across a cylinder bore of the cylinder block, and wherein the air intake passage is fluidly connected with one of the pairs of the scavenging passages, which is closest to an exhaust port.

13. A combustion engine which comprises:

a crankcase for operatively supporting a crankshaft and including first and second crank casings that are split in a direction conforming to an axis of the crankshaft; and a cylinder block connected with an upper portion of the crankcase by means of a fastening member;

wherein the fastening member is fitted in a direction upwardly from a crankcase-side and the cylinder block has an air intake passage defined therein for introducing air from one side of the cylinder block to a scavenging passage formed in the cylinder block, the air intake passage being positioned above the fastening member and open at the one side of the cylinder block.

14. The combustion engine as claimed in claim 13, wherein the scavenging passage is provided in two pairs, respective scavenging passages of each pair being positioned across a cylinder bore of the cylinder block, and wherein the air intake passage is fluidly connected with the pairs of the scavenging passages.

15. The combustion engine as claimed in claim 13, wherein the scavenging passage is provided in two pairs, respective scavenging passages of each pair being positioned across a cylinder bore of the cylinder block, and wherein the air intake passage is fluidly connected with one of the pairs of the scavenging passages, which is closest to an exhaust port.

* * * * *